US005139862A

United States Patent [19]

Swift et al.

[11] Patent Number: 5,139,862

[45] Date of Patent: Aug. 18, 1992

[54] PULTRUDED ELECTRONIC DEVICE

[75] Inventors: Joseph A. Swift, Ontario; Stanley J. Wallace, Victor; Wilbur M. Peck, Rochester, all of N.Y.

[73] Assignee: Xerox Corporation, Stamford, Conn.

[21] Appl. No.: 806,061

[22] Filed: Dec. 11, 1991

Related U.S. Application Data

[63] Continuation-in-part of Ser. No. 272,280, Nov. 17, 1989.

[51] Int. Cl.[5] ..... H01B 1/24; H01H 1/02; H01H 11/04; H01R 39/24; H01R 43/00

[52] U.S. Cl. ..... 428/294; 156/47; 156/180; 174/126.2; 200/262; 200/265; 264/172; 264/174; 264/210.1; 271/258; 310/249; 310/251; 310/253; 338/66; 338/214; 355/308; 355/321; 361/220; 361/222; 428/338; 428/408

[58] Field of Search ..... 156/47, 180; 174/126.2; 200/262, 265; 264/172, 174, 210.1; 271/258; 310/249, 252, 253; 338/66, 214; 355/308, 321; 361/220, 222; 428/294, 408, 338

[56] References Cited

U.S. PATENT DOCUMENTS

| | | | |
|---|---|---|---|
| 3,254,189 | 5/1966 | Evanicsko et al. | 200/262 |
| 3,996,408 | 12/1976 | Fridman et al. | 428/408 |
| 4,119,572 | 10/1978 | Fridman et al. | 252/506 |
| 4,140,832 | 2/1979 | Menegay | 428/288 |
| 4,347,287 | 8/1982 | Lewis et al. | 428/378 |
| 4,358,699 | 11/1982 | Wilsdorf | 310/251 |
| 4,369,423 | 1/1983 | Holtzberg | 338/66 |
| 4,415,635 | 11/1983 | Wilsdorf et al. | 428/611 |
| 4,440,593 | 4/1984 | Goldsworthy | 156/180 |
| 4,443,726 | 4/1984 | Ikegami et al. | 310/248 |
| 4,453,191 | 11/1985 | Franks et al. | 361/212 |
| 4,494,123 | 1/1985 | Moore et al. | 343/900 |
| 4,495,017 | 1/1985 | Abe et al. | 156/181 |
| 4,569,786 | 2/1986 | Deguchi | 252/503 |
| 4,641,949 | 2/1987 | Wallace et al. . | |
| 4,680,224 | 7/1987 | O'Connor | 428/408 |
| 4,761,709 | 8/1988 | Ewing | 361/225 |
| 4,892,764 | 1/1990 | Drain et al. | 264/174 |

OTHER PUBLICATIONS

"Handbook of Pultrusion Technology", by Raymond W. Meyer, published 1985, Chapman and Hall, pp. iii–v, vii, ix and 1–12.

*Primary Examiner*—James C. Cannon

[57] ABSTRACT

An electronic device for conducting electric current has two contacting components at least one of which is a nonmetallic electronic contact in the form of a pultruded composite member made of a plurality of small generally circular cross section conductive fibers in a polymer matrix, the fibers being oriented in the matrix in a direction substantially parallel to the axial direction of the pultruded composite member and being continuous from one end of the member to the other to provide a plurality of electrical point contacts at each end of the member.

46 Claims, 6 Drawing Sheets

PULTRUDED ELECTRONIC DEVICE

This application is a continuation in part of U.S. application Ser. No. 07/272,280 filed Nov. 17, 1988.

CROSS REFERENCE TO RELATED APPLICATIONS

Attention is directed to U.S. application Ser. No. 07/516,000, filed Apr. 16, 1990, in the name of Orlowski et al. and entitled "Fibrillated Pultruded Electrical Component", now abandoned, and a continuation in part thereof, U.S. application Ser. No. 806,062 filed Feb. 11, 1991. Attention is also directed to application Ser. No. 07/276,835 entitled "Machine With Removable Unit Having Two Element Electrical Connection" in the name of Ross E. Schroll et al. filed Nov. 25, 1988. Both of the above applications are commonly assigned to the assignee of the present invention.

BACKGROUND OF THE PRESENT INVENTION

The present invention relates generally to electronic devices such as connectors, switches and sensors for conducting electric current. In particular, it relates to such devices useful in various types of machines and other applications which require such electronic devices for their proper operation. More specifically, the electronic devices have two contacting components at least one of which is a nonmetallic electronic contact comprising a pultruded composite member having a plurality of small, generally circular cross section conductive fibers in a polymer matrix where the fibers are oriented in a direction parallel to the axial direction of the member and are continuous from one end of the member to the other. The devices described herein are particularly well suited for low energy electronic/micro electronic signal level circuitry typified by contemporary digital and analog signal processing practices. Typical of the type of the machines which may use such electronic devices are electrostatographic printing machines.

In electrostatographic printing apparatus commonly used today a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development the toner particles are attached from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure.

In commercial applications of such products it is necessary to distribute power and/or logic signals to various sites within the machine. Traditionally, this has taken the form of utilizing conventional wires and wiring harnesses in each machine to distribute power and logic signals to the various functional elements in an automated machine. In such distribution systems, it is necessary to provide electrical connectors between the wires and components. In addition, it is necessary to provide sensors and switches, for example, to sense the location of copy sheets, documents, etc. Similarly, other electrical devices such as interlocks, etc. are provided to enable or disable a function.

The most common devices performing these functions have traditionally relied on a metal-to-metal contacts to complete the associated electronic circuit. While this long time conventional approach has been very effective in many applications, it nevertheless suffers from several difficulties. For example, one or both of the metal contacts may be degraded over time by the formation of an insulating film due to oxidation of the metal. This film may not be capable of being pierced by the normal contact forces or by low energy (5 volts and 10 milliamps) power present in the circuit. This is complicated by the fact that according to Holm, Electric Contacts, page 1, 4th Edition, 1967, published by Springer-Verlag, no amount of force if the contacts are infinitely hard can force contact in more than three places. Corroded contacts can result in the creation of radio frequency interference (noise) which may disturb sensitive circuitry. In addition, the conventional metal to metal contacts are susceptible to contamination by dust and other debris in the machine environment. In an electrostatographic printing machine, for example, toner particles are generally airborne within the machine and may collect and deposit on one or more such contacts. Another common contaminant in a printing machine is a silicone oil which is commonly used as a fuser release agent. This contamination may also be sufficient to inhibit the necessary metal-to-metal contact. Accordingly, the direct metal-to-metal contact suffers from low reliability particularly in low energy circuits. To improve the reliability of such contacts, particularly for low energy applications, contacts have been previously made from such noble metals as gold, palladium, silver and rhodium or specially developed alloys such as palladium nickel and some applications contacts have been placed in a vacuum or hermetically sealed. In addition, metal contacts can be self-destructive and will burn out since most have positive coefficients of thermal conductivity and as the contact gets hot it becomes more resistive, thereby becoming hotter with the passage of additional current and may eventually burn or weld. Final failure may follow when the phenomena of current crowding predominates the conduction of current. In addition to being unreliable as a result of being susceptible to contamination, traditional metal contacts and particularly sliding contacts owing to high normal forces are also susceptible to wear over long periods of time.

PRIOR ART

U.S. Pat. No. 4,347,287 to Lewis et al. describes a system for forming a segmented pultruded shape in which a continuous length of fiber reinforcements are impregnated with a resin matrix material and then formed into a continuous series of alternating rigid segments and flexible segments by curing the matrix material impregnating the rigid sections and removing the matrix material impregnating the flexible sections. The matrix material is a thermosetting resin and the fiber reinforcement may be glass, graphite, boron or aramid fibers.

U.S. Pat. No. 4,569,786 to Deguchi discloses an electrically conductive thermoplastic resin composition containing metal and carbon fibers. The composition can be converted into a desired shaped product by injection molding or extrusion molding (see col. 3, lines 30–52).

U.S. Pat. No. 4,358,699 to Wilsdorf is an abundant disclosure of electrical fiber brushes which is focused by the examples on metal fibers in a metallic matrix used in high energy rather than low energy applications. Structurally, extremely small diameter metallic fibers are embedded in other fibers which may be embedded in still other fibers all held in a matrix which enables high current densities and conduction with minimal power losses by quantum mechanical tunneling.

U.S. Pat. No. 4,641,949 to Wallace et al. describes conductive brush paper position sensor wherein the brush fibers are conductive fibers made from polyacrylonitrile, each fiber acting as a separate electrical path through which the circuit is completed.

U.S. Pat. No. 4,553,191 to Franks et al. describes a static eliminator device having a plurality of resilient flexible thin fibers having a resistivity of from about $2\times10^3$ ohm-centimeters to $1\times10^6$ ohm-centimeters. Preferably, the fibers are made of a partially carbonized polyacrylonitrile fiber.

U.S. Pat. No. 4,369,423 to Holtzberg describes a composite automobile ignition cable which has an electrically conductive core comprising a plurality of mechanically and electrically continuous filaments such as graphitized polyacrylonitrile and electrically insulating elastomeric jacket which surrounds and envelopes the filaments.

U.S. Pat. No. 4,761,709 to Ewing et al. describes a contact brush charging device having a plurality of resiliently flexible thin fibers having a resistivity of from about $10^2$ ohms-cm to about $10^6$ ohm-cm which are substantially resistivity stable to changes in relative humidity and temperature. Preferably the fibers are made of a partially carbonized polyacrylonitrile fiber.

*Electric Contacts* by Ragnar Holm, 4th Edition, published by Springer-Verlag, 1967, pages 1–53, 118–134, 228, 259 is a comprehensive description of the theory of electrical contacts, particularly metal contacts.

SUMMARY OF THE INVENTION

The present invention is directed to a device for conducting electric current comprising two contacting components at least one of which is a nonmetallic electronic contact comprising a pultruded composite member comprising a plurality of small generally circular cross section conductive fibers in a polymer matrix, the fibers being oriented in the matrix in the direction substantially parallel to the axial direction of the member and being continuous from one end of the member to the other to provide a plurality of electrical point contacts at each end of the member. Typically the device is a switch, sensor or connector.

In a further aspect of the present invention, the conductive fibers are carbon fibers preferably carbonized polyacrylonitrile fibers.

In a further aspect of the present invention, the fibers are generally circular in cross section and have a diameter of from about 4 micrometers to about 50 micrometers and preferably from about 7 micrometers to about 10 micrometers.

In a further aspect of the present invention, the fibers have DC volume resistivity of from about $1\times10^{-5}$ to about $1\times10^{10}$ ohm-cm and preferably from about $1\times10^{-4}$ to about 10 ohm-cm.

In a further aspect of the present invention, the fibers are present in the pultruded component in an amount of from about 5% to about 98% by weight, and preferably at least 50% by weight.

In a further aspects of the present invention, the polymer matrix is a structural thermoplastic or thermosetting resin and is preferably a polyester.

In a further principle aspect of the present invention, the pultruded member is mechanical member as well as an electrical component.

In a further aspect of the present invention, both components are pultruded members and one or both of them function as mechanical member as well as an electrical components.

In a further aspect of the present invention, the pultruded member has at least one mechanical feature incorporated therein.

In a further aspect of the present invention, the two components of the device are maintained in contact by a flexible fastener.

In a further aspect of the present invention, the polymer matrix is a thermosetting elastomer.

In a further aspect of the present invention the devices are used in low energy circuits having currents in the range of micro to milliamps and voltages in the range of millivolts to hundreds of volts.

In a further significant aspect of the present invention, a machine including a plurality of electrical components each requiring the supply of electrical current for proper functioning includes at least one of the electronic devices described herein.

BRIEF DESCRIPTION OF THE DRAWINGS

The invention is illustrated with reference to the following representative figures in which the dimensions of parts are not necessarily to scale but rather may be exaggerated or distorted for clarity of illustration and case of description.

DETAILED DESCRIPTION OF THE INVENTION

Figure 1:
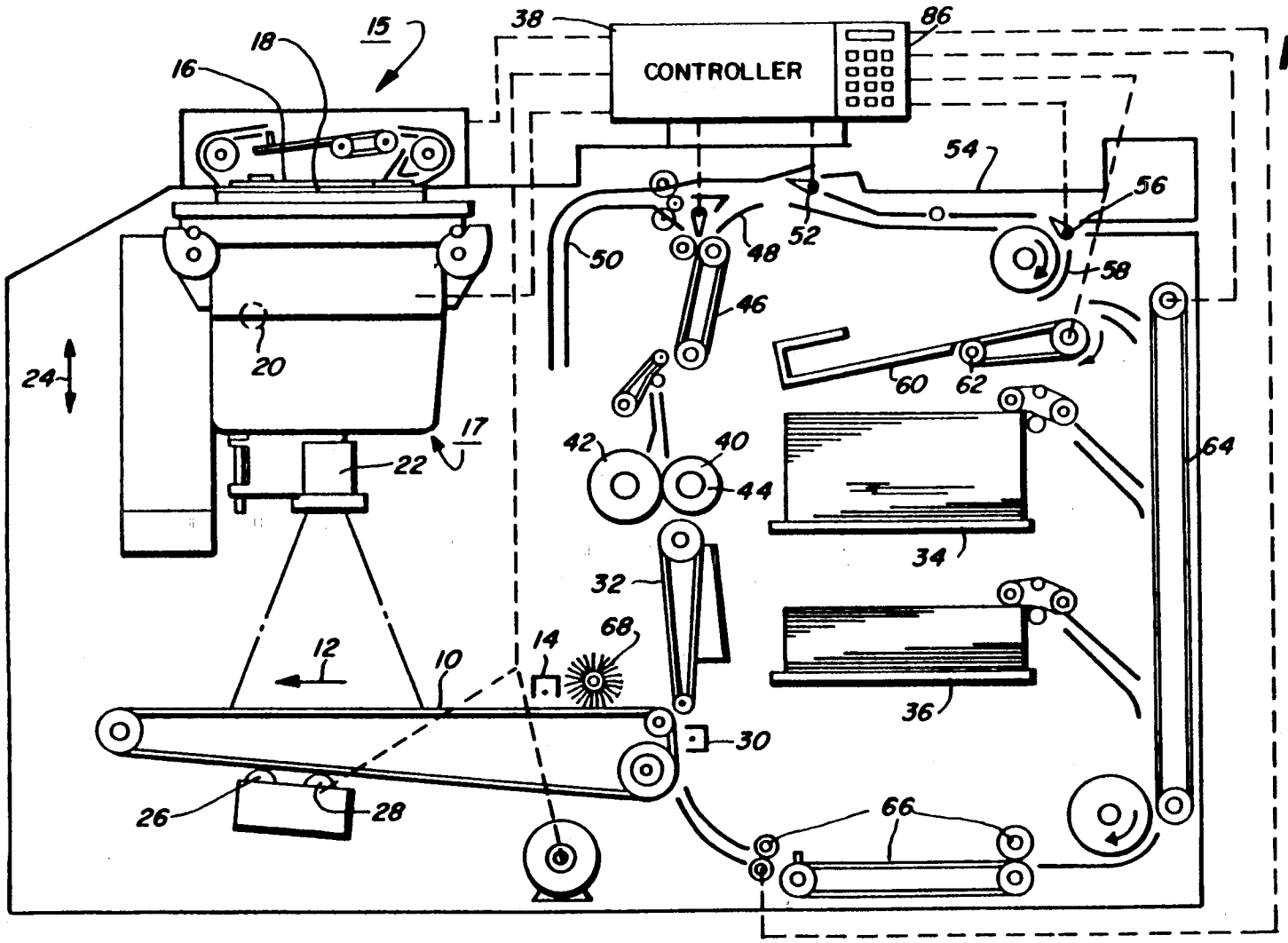
FIG. 1 is a representation in cross section of an automatic electrostatographic printing machine which may incorporate the present invention.

In accordance with the present invention, a variety of electronic devices for conducting electrical current such as switches, sensors, connectors, interlocks, etc. are provided with greatly improved reliability, are of low cost and easily manufacturable and are capable of reliably operating in low energy circuits. Typically these devices are low energy devices, using low voltages within the range of millivolts to hundreds of volts and currents within the range of microamps to hundreds of milliamps as opposed to power applications of tens to hundreds of amperes, for example. Although the present invention may be used in certain applications in the single amp region it is noted that best results are obtained in high resistance circuitry where power losses can be tolerated. It is also noted that these devices may be used in certain application in the high voltage region in excess of 10,000 volts, for example, where excessive heat is not generated. These devices are generally electronic in nature within the generic field of electrical devices meaning that their principle applications are in signal level circuits although as previously stated they may be used in certain low power application where their inherent power losses may be tolerated. Furthermore, it is possible for these electronic devices in addition to performing an electrical function to provide a mechanical or structural function.

The above advantages are enabled through the used of a manufacturing process known generally as pultrusion. This process generally consists of pulling continuous lengths of fibers through a resin bath or impregnator and then into a preforming fixture where the section is partially shaped and excess resin and/or air are removed and then into heated dies where the section is cured continuously. Typically, the process is used to make fiberglass reinforced plastic, pultruded shapes. For a detailed discussion of pultrusion technology, reference is directed to "Handbook of Pultrusion Technology" by Raymond W. Meyer, first published in 1985 by Chapman and Hall, New York. In the practice of the present invention conductive carbon fibers are submersed in a polymer bath and drawn through a die opening of suitable shape at high temperature to produce a solid piece of dimensions and shapes of the die which can be cut, shaped and machined. As a result, thousands of conductive fiber elements are contained within the polymer matrix whose ends are exposed to surfaces to provide electronic contacts. This high degree of redundancy and availability of electrical point contacts enables a substantial improvement in the reliability of these devices. Since the plurality of small diameter conductive fibers are pulled through the polymer bath and heated die as a continuous length, the shaped member is formed with the fibers being continuous from one end of the member to the other and oriented within the resin matrix in a direction substantially parallel to the axial direction of the member. By the term "axial direction" it is intended to define in a lengthwise or longitudinal direction or along the major axis. Accordingly, the pultruded composite may be formed in a continuous length and cut to any suitable dimension providing at each end a very large number of electrical point contacts, the ends of each of the individual fibers. As will become apparent hereinafter, these pultruded composite members may be used for either one or two of the contacting components in the device for conducting electric current. If only one pultruded member is used the other contact may be any suitable contact selected from conventional conductors and nonconductors.

Any suitable fiber may be used in the practice of the present invention. Typically, the conductive fibers are nonmetallic and have a DC volume resistivity of from about $1\times10^{-5}$ to about $1\times10^{10}$ ohm-cm and preferably from about $1\times10^{-4}$ to about 10 ohm-cm to minimize resistance losses. The upper range of resistivities of up to $1\times10^{10}$ ohm-cm. could be used, for example, in those special applications involving extremely high fiber densities where the individual fibers act as individual resistors in parallel thereby lowering the overall resistance of the pultruded member enabling current conduction. The vast majority of applications, however, will require fibers having resistivities within the above stated preferred range to enable current conduction.

The term "nonmetallic" is used to distinguish from conventional metal fibers which exhibit metallic conductivity having resistivities of the order of $1\times10^{-6}$ ohm-cm and to define a class of fibers which are nonmetallic but can be treated in ways to approach or provide metal like properties. Higher resistivity materials may be used if the impedance of the associated electronic circuit is sufficiently high. In addition, the individual conductive fibers are generally circular in cross section and have a diameter generally in the order of from about 4 to about 50 micrometers and preferably from about 7 to 9 micrometers which provides a very high degree of redundancy in a small axial area. The fibers are typically flexible and compatible with the polymer systems. Typical fibers include carbon and carbon/graphite.

A particularly preferred fiber that may be used are those fibers that are obtained from the controlled heat treatment processing to yield partial carbonization of the polyacrylonitrile (PAN) precursor fibers. It has been found for such fibers that by carefully controlling the temperature of carbonization within certain limits that precise electrical resistivities for the carbonized carbon fibers may be obtained. The polyacrylonitrile precursor fibers are commercially produced by the Stackpole Company, Celion Carbon Fibers, Inc., division of BASF and others in yarn handles of 1,000 to 160,000 filaments. The yarn bundles are partially carbonized in a two-stage process involving stabilizing the PAN fibers at temperatures of the order of 300° C. in an oxygen atmosphere to produce preox-stabilized PAN fibers followed by carbonization at elevated temperatures in an inert (nitrogen) atmosphere. The D.C. electrical resistivity of the resulting fibers is controlled by the selection of the temperature of carbonization. For example, carbon fibers having an electrical resistivity of from about $10^2$ to about $10^6$ ohms-cm are obtained if the carbonization temperature is controlled in the range of from about 500° C. to 750° C. For further reference to the processes that may be employed in making these carbonized fibers attention is directed the above-referenced U.S. Pat. No. 4,761,709 to Ewing et al. and the literature sources cited therein at column 8. Typically these carbon fibers have a modulus of from about 30 million to 60 million psi or 205–411 GPa which is higher than most steels thereby enabling a very strong pultruded composite member. The high temperature conversion of the polyacrylonitrile fibers results in a fiber which is about 99.99% elemental carbon which is inert and which when used in a high energy application upon oxidation will yield only carbon monoxide or carbon dioxide which are gases that do not contaminate the fiber end contacts.

One of the advantages of using conductive carbon fibers is that they have a negative coefficient of thermal conductivity so that as the temperature increases the fiber resistance decreases. This provides an advantage over metal fibers since the metal fibers operate in just the opposite manner and therefore may degrade through a process of thermal runaway. The carbon fibers have a further advantage in that their surfaces are inherently rough thereby providing better adhesion to the polymer matrix. In addition, the inertness of the carbon material yields a contact surface relatively immune to contaminants.

Any suitable polymer matrix may be employed in the practice of the present invention. The polymer may be insulating or conducting. If cross directional electrical connection is desired along the edges of the pultrusion a conducting polymer may be used. Conversely, if insulating properties are desired along the edges of the pultrusion an insulating polymer may be used, or insulating fibers can be used in the outer periphery of the pultruded configuration and the conducting fibers can be configured to reside away from the edges.

Typically, the polymer is selected from the group of structural thermoplastic and thermosetting resins. Polyesters, epoxies, vinyl esters, polyetheretherketones, polyetherimides, polyethersulphones, polypropylene and nylon are in general, suitable materials with the polyesters being preferred due to their short cure time and relative chemical inertness. If an elastomeric matrix is desired, a silicone, fluorosilicone or polyurethane elastomer may provide the polymer matrix. Typical specific materials include Hetron 613, Arpol 7030 and 7362 available from Oshland Oil, Inc., Dion Iso 6315 available from Koppers Company, Inc. and Silmar S-7956 available from Vestron Corporation. For additional information on suitable resins attention is directed to Chapter 4 of the above-referenced Handbook by Meyer. Other materials may be added to the polymer bath to provide their properties such as corrosion or flame resistance as desired. In addition, the polymer bath may contain fillers such as calcium carbonate, alumina, silica or pigments to provide a certain color or lubricants to reduce friction, for example, in sliding contacts. Further additives to alter the viscosity, surface tension or to assist in bonding the pultrusion to the other materials may be added. Naturally, if the fiber has a sizing applied to it, a compatible polymer should be selected. For example, if an epoxy resin is being used, it would be appropriate to add an epoxy sizing to the fiber to promote adhesion.

The fiber loading in the polymer matrix depends upon the conductivity desired and the cross sectional area. Typically, the resins have a specific gravity of from about 1.1 to about 1.5 while the fibers have a specific gravity of from about 1.7 to about 2.5. In providing the levels of conductivity heretofore mentioned, typically the pultruded composite member is more than 50% by weight fiber and preferably more than 80 or even 90% fiber, the higher fiber loadings providing more fibers for contacts having low bulk resistivity. To increase the conductivity of the matrix additional conductive fiber may be added.

Figure 8:
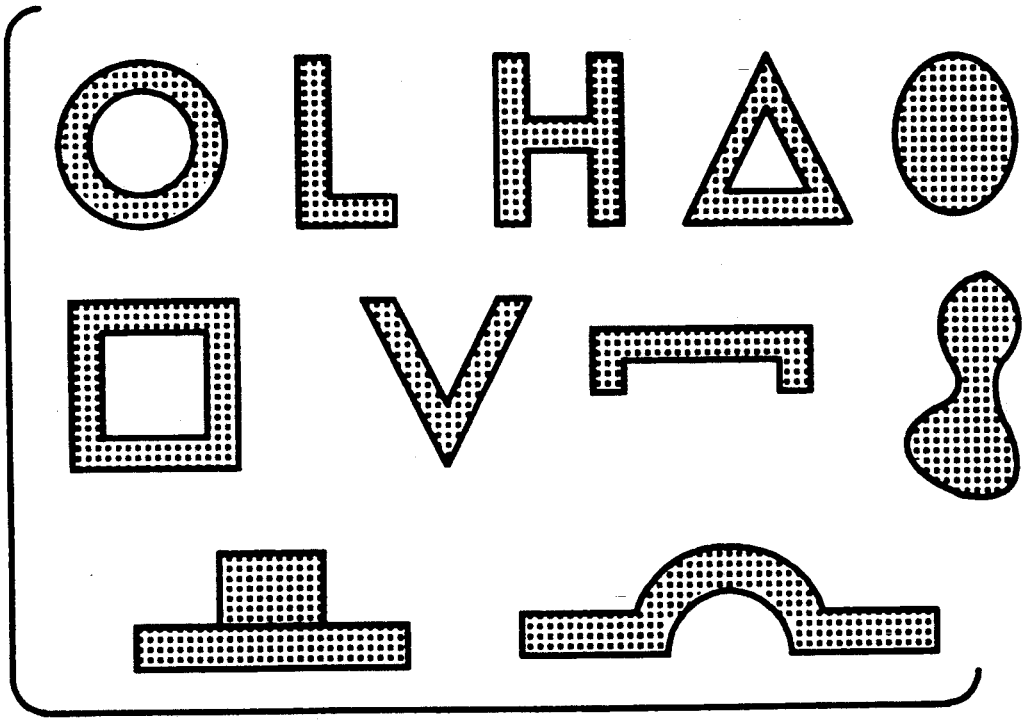
FIG. 8 illustrates a variety of representative cross sections the pultruded member may take.

The pultruded composite members may be prepared according to the pultrusion technique as described, for example, by Meyer in "Handbook of Pultrusion Technology". In general, this will involve the steps of prerinsing the continuous multi-filament strand of conductive carbon fibers in a pre-rinse bath followed by pulling the continuous strand through the molten or liquid polymer followed by pulling it through a heated die which may be at the curing temperature of the resin into a oven dryer if such is necessary to a cut-off or take-up position. For further and more complete details of the process attention is directed to Meyer. While the desired final shape of the pultruded composite member may be that provided by the die and pulling technique variations, alternatively it is capable of being machined with conventional carbide tools. Typically, holes, slots, ridges, grooves, convex or concave contact areas or screw threads may be formed in the pultruded composite member by conventional machining techniques. Alternatively, the pultrusion process may be modified such that when the pultrusion is initially removed from the die it is pliable and can be bent or otherwise shaped to a form which upon further curing becomes a rigid structural member. Further, if the resin is a thermoplastic, the process can be adjusted such that the part is removed hot from the die, shaped and then cooled to solidify. Attention is directed to FIG. 8 wherein a variety of die configurations are illustrated which may be used to produce the corresponding pultruded cross sectional shapes. While the individual dots representing the individual fibers are depicted in an orderly pattern, it will be understood that they more generally appear in a random pattern. It will also be understood that the size of the dots greatly exaggerates the size of the fibers.

Typically, the fibers are supplied as continuous filament yarns having, for example, 1, 3, 6, 12 or up to 160 thousand filaments per yarn. Typically the fibers provide in the formed pultruded member from about $1\times10^5$ (a nominal 8 micrometer diameter fiber at 45% by weight loading in the pultrusion) to about $1\times10^7$ (a nominal 4 micrometer diameter fiber at 90% by weight loading in the pultrusion) point contacts per $cm^2$.

A pultruded member so formed may be used to provide at least one of the contacting components in a device which depends on that contact in its operation. In addition or alternatively both of the contacts may be made from similar or dissimilar pultruded composite members. Furthermore, one or both of the contacts may provide a mechanical or structural function. For example, in addition to performing as an electrical connector, a pultruded member may also function as a mechanical member such as a bracket or other structural support. A pultruded member may provide mechanical features such as a guide rail or pin or stop member or as a rail for a scanning head to ride on and also provide a ground return path. Accordingly, functions can be combined and parts reduced and in fact a single piece can function as electronic contact, support piece for itself and an electrical connection.

Attention is directed to FIGS. 1 through 6 in the drawings for a better understanding of the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit 15 positions an original document 16 facedown over exposure system 17. The exposure system 17 includes lamp 20 illuminating the document 16 positioned on transparent platen 18. The light rays reflected from document 16 are transmitted through lens 22 which focuses the light image of original document 16 onto the charged portion of the photoconductive surface of belt 10 to selectively dissipate the charge. This records an electrostatic latent image on the photoconductive surface corresponding to the information areas contained within the original document.

Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

Document handling unit 15 sequentially feeds documents from a holding tray, seriatim, to platen 18. The document handling unit recirculates documents back to the stack supported on the tray. Thereafter, belt 10 advances the electrostatic latent image recorded on the photoconductive surface to a development station.

At the development station a pair of magnetic brush developer rollers 26 and 28 advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 and 36 to the transfer station. After transfer, conveyor 32 advances the sheet to a fusing station. The fusing station includes a fuser assembly for permanently affixing the transferred powder image to the copy sheet. Preferably, fuser assembly 40 includes a heated fuser roller 42 and a backup roller 44 with the powder image contacting fuser roller 42.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second gate 52. Decision gate 52 deflects the sheet directly into an output tray 54 or deflects the sheet into a transport path which carries them on without inversion to a third gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

Figure 2:
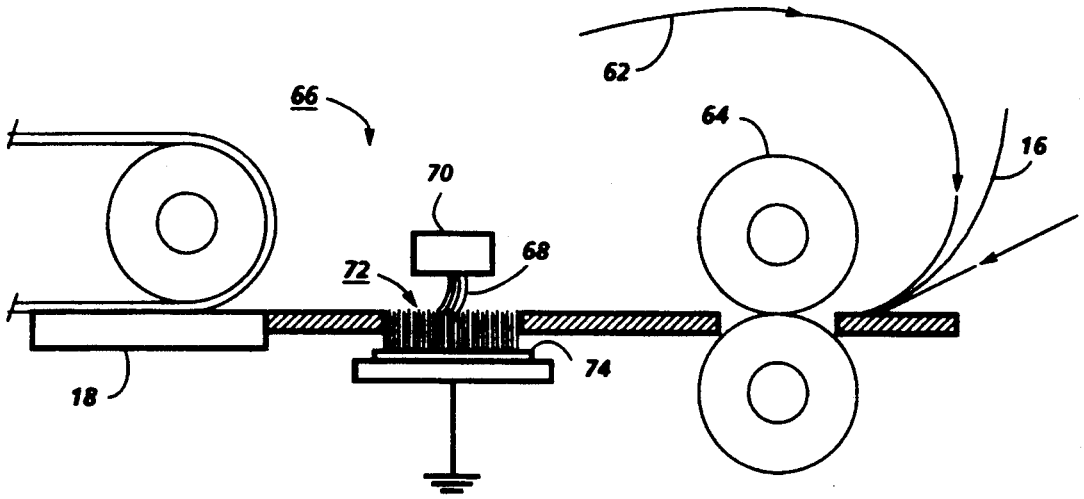
FIG. 2 illustrates in greater detail the document handler of FIG. 1 which may incorporate the present invention.

With reference to FIG. 2, there is shown the path 62 of movement of a document 16 driven by pinch rolls 64 through document size sensor array 66 onto platen 18. The document size sensor array 66 generally includes an array of oppositely disposed conductive contacts. One such pair is illustrated as fiber brush 68 carried in upper support 70 in electrical contact with pultruded composite member 72 as illustrated in greater detail in FIG. 3 carried in lower conductive support 74. The pultruded composite member comprises a plurality of conductive fibers 71 in a polymer matrix 75 having surface 73 with the one end of the fibers being available for contact with the fibers of the brush 68 which is mounted transversely to the sheet path to contact and be deflected by passage of a document between the contacts. When no document is present, the brush fibers form a closed electrical circuit with the surface 73 of the pultruded member 72. It should be noted that single position sensors can also be used. With reference to the pultruded members illustrated in FIGS. 2 and 3 as previously discussed, it will be appreciated that the fiber loading of the member is typically much greater than illustrated.

Figure 3:
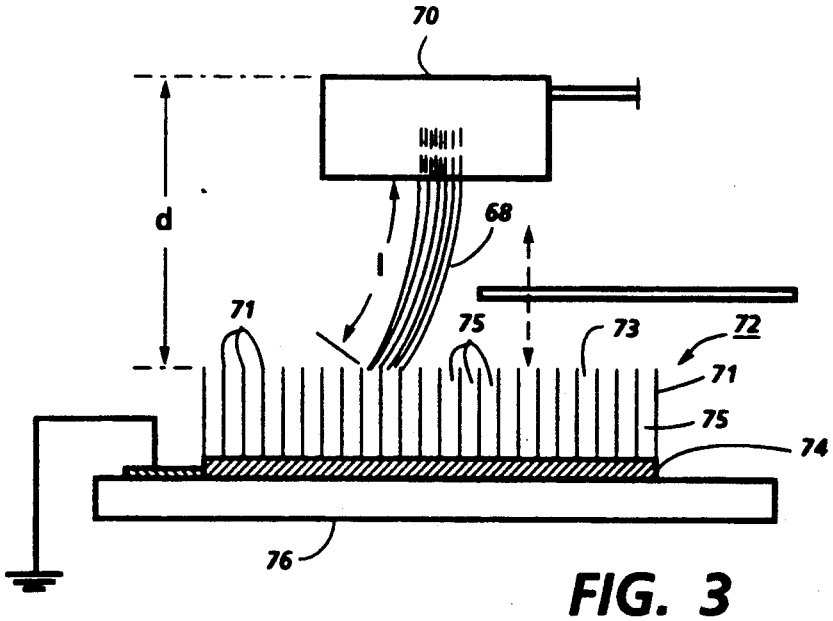
FIG. 3 is an enlarged sectional view illustrating a sensor according to the present invention.

A test was conducted of the device illustrated in FIG. 3 wherein fiber brush 68 was made of Celion C-6000 a polyacrylonitrile fiber available from Celion Carbon Fibers, Inc., a division of BASF, Charlotte, N.C. with 6000 fibers per yarn. The fibers have a 0.7% by weight sizing of polyvinylpyrolidone, a resistivity of $10^{-3}$ ohm-cm and are 7 to 10 micrometers in diameter. The brush was formed by encasing one end of the fibers in an ultrasonically welded conductive plastic holder and the other contact 72 was a pultruded pellet having a circular cross section about 6 mm in diameter cut to a length of about 3 mm. The pultruded pellet was formed from carbon fibers 7 to 10 micrometers in diameter having a resistivity of about $10^{-3}$ ohm cm in a polyester matrix of which 30% to 50% by weight was fiber. The pellet stock is available from Diversified Fabricators, Incl., Winona, Minn.

The pellet was attached to the conductive plate using a silver filled conductive epoxy and the switch as formed was connected to a DC power supply of 5 volts through a current sensing resistor which allows 10 milliamps to flow through the contact. In a test fixture, the sensor was actuated for a hundred million actuations without failure. A similar test was conducted except that the pultruded contact was replaced with a metal contact. When placed in the test fixture, failure was experienced after about one hundred thousand actuations as a result of an oxide buildup on the metal contact and relatively low force on the brush being insufficient at such low energy levels to pierce the contaminant layer.

Additional tests were conducted for the device illustrated in FIG. 3 where the pultruded member had been immersed in fuser oil, water or had toner spilled on it. In each instance, it was demonstrated that effective switching was achieved even under such high level of contact contamination.

Figure 4:
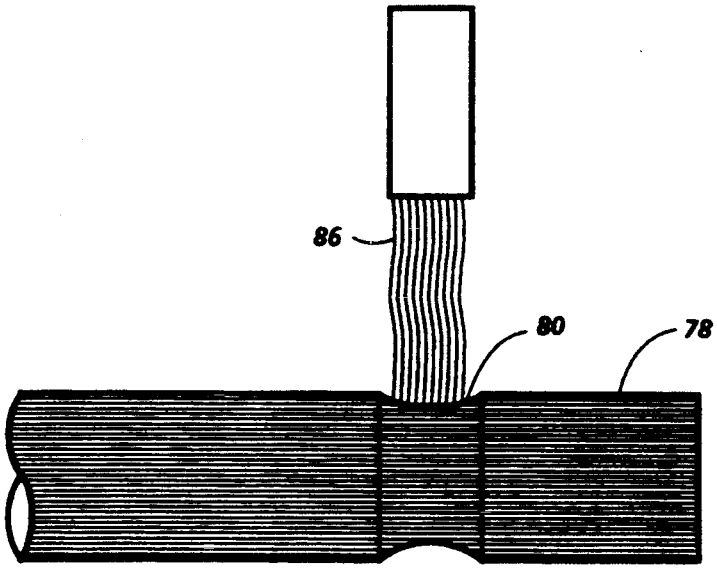
FIG. 4 illustrates an electrical connection between the pultruded member and a conductive fiber brush.
Figure 5:
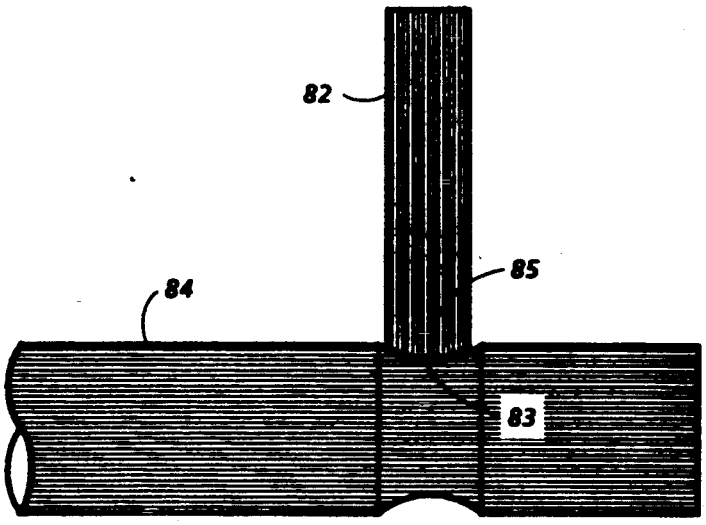
FIG. 5 illustrates an electrical connection wherein both contacts are pultruded members one of which has been machined to provide an accurate contact location.
Figure 6:
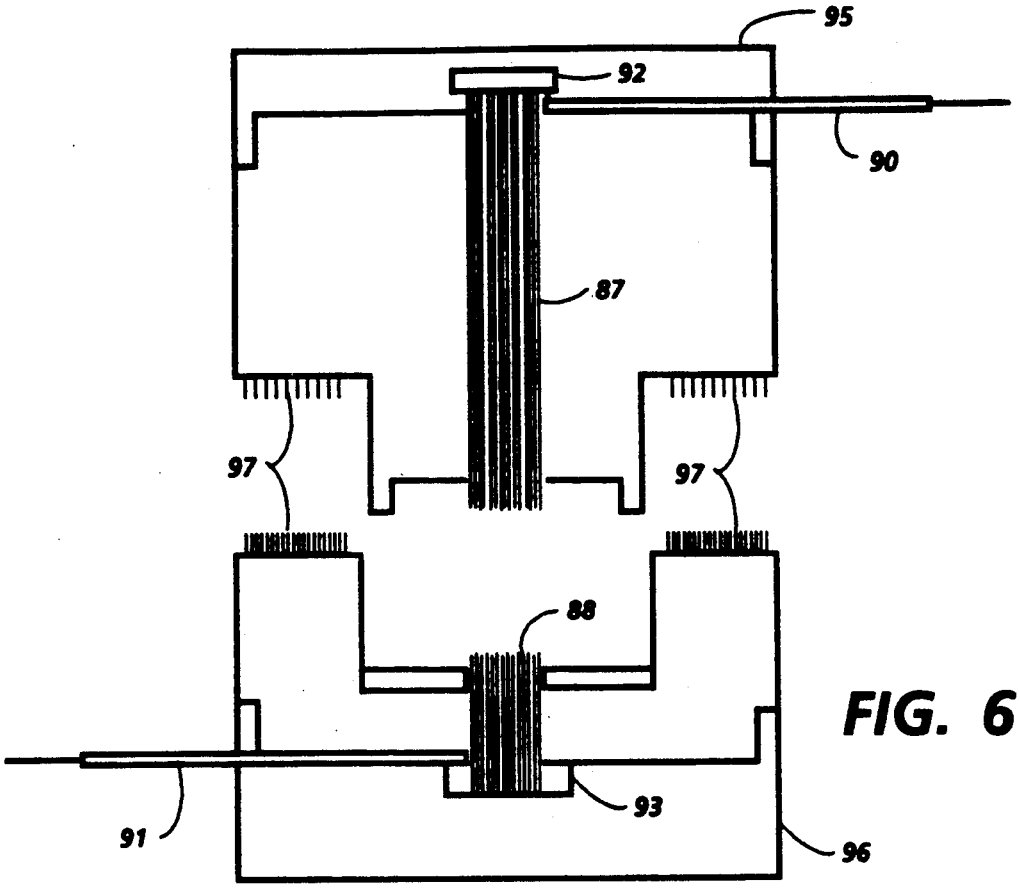
FIG. 6 is an illustration in cross section of an electrical connection between two pultruded members which are contained within plastic end caps and held together through the use of a flexible fastener.

Attention is directed to FIG. 4 wherein an alternative embodiment of the type of device is illustrated. More specifically, the pultruded composite member 78 has been machined to provide a rounded groove 80 therein to provide contact with the fibers of a similar brush contact 86. In FIG. 5, the device comprises at the contact interface two pultruded members 82 and 84 both of which have been slightly machined to assure good contact. In one member a rounded groove 83 has been provided and in the other member the end thereof has been rounded at 85 to mate with the groove. This type of contact is especially useful where 84 is a rotatable shaft member. With reference to FIG. 6, a device including two pultruded composite members forming a connector is illustrated. Each of the pultruded members 87, 88 is connected to an electrical wire 90 and 91, respectively, through a hole in the end of the pultruded member and they are contained in molded plastic end caps 92, 93 in housing 95, 96. The connector is designed as a male and female compatible unit which is held together by flexible fastener material such as Velcro a trademark of Velcro Company or Scotch Flexlock 97 a trademark of 3M. Naturally, the pultruded composite member may be joined in electrical contact with a wire for example with well known techniques such as crimping, inserting the electrical lead or wire through a drilled hole in the pultruded member soldering or adhesively securing it, etc.

Figure 7:
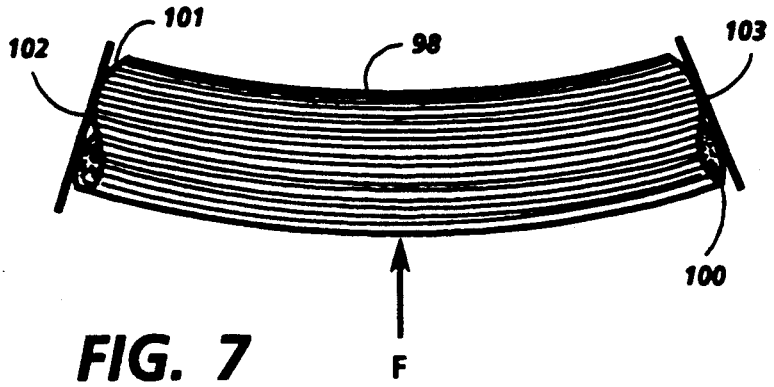
FIG. 7 illustrates an electrical connection wherein the pultruded member is an elastomeric member biased into the contacting relationship.

FIG. 7 illustrates an elastomeric pultruded member 98 biased into electrical contact at each end 100, 101 with contacts 102, 103 by a force exerted near the fulcrum center.

Figure 9A:
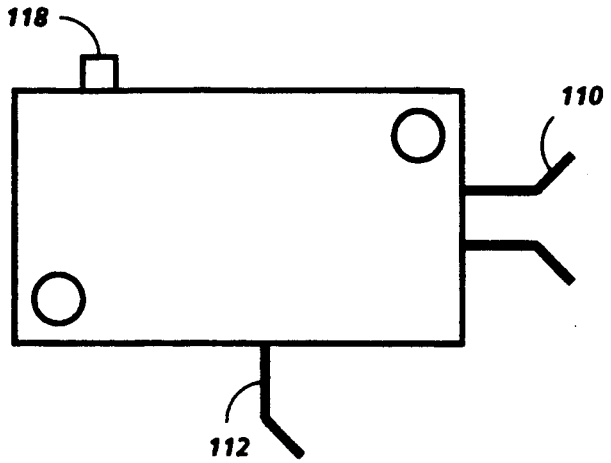
FIGS. 9A and 9B are a side view and an enlarged sectional view respectively of a switch according to the present invention.
Figure 9B:
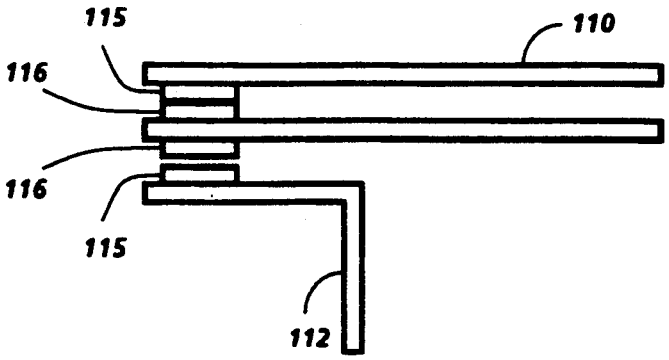

FIGS. 9A and 9B schematically illustrate a preferred embodiment of a switch where all the switch contacts are slices of a pultruded carbon fiber composite member. The switch comprises two fixed terminals 110, 112 in a box each having a slice 115 of a pultruded carbon fiber composite as a contacting member with an arm movable between a closed or rest position in contact with terminal 110 and an open position in contact with terminal 112. Actuator 118 moves the movable arm between terminals 110 and 112 by a mechanism (not shown).

While the device has been illustrated as a low level sensor or switch it will be understood that it has utility in other applications. For example, the device can be used in the range of logic level signals, relays, thermostat contacts, position sensing, open air switches as well as, non-metallic buses, corotron array connections, grounding or biasing elements, supply outputs, etc.

According to the present invention, an extremely reliable electrical device useful as a sensor, switch, connector, interlock, etc. has been provided. This reliability is achieved as result of using the composite pultruded members which provide such an enormously large number of potential electrical contacts that the electrical redundancy is orders of magnitude greater than conventional metal-to-metal contact. Furthermore, the contact does not degrade by oxidation over time, and its integrity remains intact even when it is contaminated. Furthermore, connections or contacts made with these devices require low mechanical forces to maintain contact integrity. The device is relatively low in cost, and easily manufacturable into a variety of cross sectional shapes and can be used while providing both a structural and mechanical function. It provides a high contact reliability at a relatively low cost. It is capable of functioning for very extended periods of time in low energy configurations. These are also capable of functioning in a high voltage system, for example, in conjunction with the composite automobile ignition cable described in U.S. Pat. No. 4,369,423 to Holtzberg. Such a system will be free of electromagnetic interference or radio frequency interference since the carbon wire in the contact would tend to dissipate any transient currents in the wire before any interference is generated which would otherwise interfere with the logic. In addition, when compared to metal-to-metal contacts, the pultruded composite members according to the present invention experience low internal stress on heating and cooling since they have a lower linear coefficient of thermal expansion.

The disclosures of the cross referenced applications, patents and the other references including the Meyer book and Holm book referred to herein, are hereby specifically and totally incorporated herein by reference.

While the invention has been described with reference to specific embodiments, it will be apparent to those skilled in the art that many alternatives, modifications and variations may be made. For example, while the invention has been generally illustrated for use in electrostatographic printing apparatus, it will be appreciated that it has equal application to a larger array of machines with electrical components. Accordingly, it is intended to embrace all such alternative and modifications as may fall within the spirit and scope of the appended claims.

We claim:

1. An electronic device for conducting electric current comprising two contacting components at least one of said components being a nonmetallic electronic contact comprising a pultruded composite member comprising a plurality of small generally circular cross section conductive fibers in a polymer matrix said plurality of fibers being oriented in said matrix in a direction substantially parallel to the axial direction of said member and being continuous from one end of said member to the other to provide a plurality of potential electrical point contacts at each end of said member.

2. The device of claim 1 wherein said conductive fibers are carbon fibers.

3. The device of claim 2 wherein said carbon fibers are carbonized polyacrylonitrile fibers.

4. The device of claim 1 wherein the fibers are generally circular in cross section have a diameter of from about 4 micrometers to about 50 micrometers.

5. The device of claim 4 wherein the fibers have a diameter of from about 7 micrometers to about 10 micrometers.

6. The device of claim 1 wherein the fibers have a DC volume resistivity of from about $1\times10^{-5}$ ohm-cm to about $1\times10^{10}$ ohm-cm.

7. The device of claim 6 wherein the fibers have DC volume resistivity of from about $1\times10^{-4}$ ohm cm to about 10 ohm-cm.

8. The device of claim 1 wherein said at least one of said components comprises at least 5% by weight fibers.

9. The device of claim 8 wherein said at least one of said components comprises at least 50% by weight fibers.

10. The device of claim 9 wherein said at least one of said components comprises about 90% by weight fibers.

11. The device of claim 1 wherein said device is a low energy device using low voltages and low currents.

12. The device of claim 1 wherein said pultruded member has from about $1\times10^5$ to about $1\times10^7$ point contacts per $cm^2$.

13. The device of claim 1 wherein said polymer matrix is a structural thermoplastic or thermosetting resin.

14. The device of claim 11 wherein said resin is a polyester or epoxy.

15. The device of claim 1 wherein said polymer is a crosslinked silicone elastomer.

16. The device of claim 1 wherein said pultruded member is a rigid mechanical member as well as an electrical component.

17. The device of claim 1 wherein both of said components are pultruded members.

18. The device of claim 17 wherein said conductive fibers of both of said components are carbon fibers.

19. The device of claim 17 wherein at least one of said pultruded members is a mechanical member as well as an electrical component.

20. The device of claim 17 wherein both of said pultruded members are mechanical members.

21. The device of claim 1 wherein said pultruded member has at least one mechanical feature incorporated therein.

22. The device of claim 16 wherein said pultruded member has at least one mechanical feature incorporated therein.

23. The device of claim 1 wherein said two components are maintained in contact by a flexible fastener.

24. A switch, sensor or connector as defined by the device of claim 1.

25. A machine including a plurality of electrical components each requiring the supply of electrical current for proper functioning, said machine including at least one electronic device for conducting electric current comprising two contacting components at least one of said components being a nonmetallic electronic contact comprising a pultruded composite member comprising a plurality of small generally circular cross section conductive fibers in a polymer matrix said plurality of fibers being oriented in said matrix in a direction substantially parallel to the axial direction of said member and being continuous from one end of said member to the other to provide a plurality of electrical point contacts at each end of said member.

26. The machine of claim 25 wherein said conductive fibers are carbon fibers.

27. The machine of claim 26 wherein said carbon fibers are carbonized polyacrylonitrile fibers.

28. The machine of claim 25 wherein the fibers have a diameter of from about 4 micrometers to about 50 micrometers.

29. The machine of claim 28 wherein the fibers have a diameter of from about 7 micrometers to about 10 micrometers.

30. The machine of claim 25 wherein the fibers have a DC volume resistivity of from about $1\times10^{-5}$ ohm-cm to about $1\times10^{10}$ ohm-cm.

31. The machine of claim 30 wherein the fibers have DC volume resistivity of from about $1\times10^{-4}$ ohm-cm to about 10 ohm-cm.

32. The machine of claim 25 wherein said at least one of said components comprises at least 5% by weight fibers.

33. The machine of claim 32 wherein said at least one of said components comprises at least 50% by weight fibers.

34. The machine of claim 33 wherein said at least one of said components comprises about 90% by weight fibers.

35. The machine of claim 25 wherein said pultruded member has from about $1\times10^5$ to about $1\times10^7$ point contacts per $cm^2$.

36. The machine of claim 26 wherein said polymer matrix is a structural thermoplastic or thermosetting resin.

37. The machine of claim 36 wherein said resin is a polyester or epoxy.

38. The machine of claim 25 wherein said polymer is a crosslinked silicone elastomer.

39. The machine of claim 25 wherein said pultruded member is a rigid mechanical member as well as an electrical component.

40. The machine of claim 25 wherein both of said components are pultruded members.

41. The machine of claim 25 wherein said conductive fibers of both of said components are carbon fibers.

42. The machine of claim 41 wherein at least one of said pultruded members is a mechanical member as well as an electrical component.

43. The machine of claim 41 wherein both of said pultruded members are mechanical members.

44. The machine of claim 25 wherein said pultruded member has at least one mechanical feature incorporated therein.

45. The machine of claim 39 wherein said pultruded member has at least one mechanical feature incorporated therein.

46. The machine of claim 25 wherein said two components are maintained in contact by a flexible fastener.

* * * * *